US005823770A

United States Patent [19]

Matros et al.

[11] Patent Number: 5,823,770

[45] Date of Patent: Oct. 20, 1998

[54] PROCESS AND APPARATUS FOR OXIDIZING COMPONENTS OF A FEED GAS MIXTURE IN A HEAT REGENERATIVE REACTOR

[75] Inventors: Yurii Shaevich Matros, Chesterfield; Grigori Abramovich Bounimovitch, St. Louis; Vadim Olegovich Strots, Clayton, all of Mo.

[73] Assignee: Monsanto Company, St. Louis, Mo.

[21] Appl. No.: 806,914

[22] Filed: Feb. 26, 1997

[51] Int. Cl.[6] ..... F27D 17/00

[52] U.S. Cl. ..... 432/181; 432/179; 432/180

[58] Field of Search ..... 432/179, 180, 432/181

[56] References Cited

U.S. PATENT DOCUMENTS

| | | | |
|---|---|---|---|
| 2,121,733 | 6/1938 | Cottrell | 133/8 |
| 3,870,474 | 3/1975 | Houston | 23/277 C |
| 4,248,841 | 2/1981 | Benedick | 423/210 |
| 4,267,152 | 5/1981 | Benedick | 422/111 |
| 4,478,808 | 10/1984 | Matros et al. | 423/522 |
| 4,741,690 | 5/1988 | Heed | 431/7 |
| 4,877,592 | 10/1989 | Matros et al. | 423/245.1 |
| 5,024,817 | 6/1991 | Mattison | 422/111 |
| 5,101,741 | 4/1992 | Gross et al. | 432/181 |
| 5,145,363 | 9/1992 | Nielsen et al. | 432/181 |
| 5,145,652 | 9/1992 | Veser et al. | 422/171 |
| 5,161,968 | 11/1992 | Nutcher et al. | 432/179 |
| 5,163,829 | 11/1992 | Wildenberg | 431/5 |
| 5,188,804 | 2/1993 | Pace et al. | 422/111 |
| 5,229,071 | 7/1993 | Meo, III | 422/2 |
| 5,262,131 | 11/1993 | Bayer et al. | 422/175 |
| 5,366,708 | 11/1994 | Matros et al. | 423/210 |
| 5,376,340 | 12/1994 | Bayer et al. | 422/175 |
| 5,417,927 | 5/1995 | Houston | 422/110 |
| 5,453,259 | 9/1995 | D'Souza | 423/245.1 |
| 5,589,142 | 12/1996 | Gribbon | 432/181 |
| 5,635,139 | 6/1997 | Holst et al. | 422/108 |
| 5,650,128 | 7/1997 | Holst et al. | 423/240 |

FOREIGN PATENT DOCUMENTS

| | | | |
|---|---|---|---|
| 0 440 181 | 9/1993 | European Pat. Off. | F23G 7/06 |
| 0 464 586 | 12/1994 | European Pat. Off. | B01D 53/36 |

OTHER PUBLICATIONS

Derwent World Patent Index (WPI) abstract for EP–B–0 440 181, WPI Acc. No. 91–231489/32, 1996.

ABB Air Preheater, Inc. brochure entitled "Practical Solutions to Your VOC, Odor or Hydrocarbon Emission Problems," 11 pages, 1995.

Derwent World Patent Index (WPI) abstract for EP–B–0 464 586, WPI Acc. No. 62–009842/02, 1996.

Wahlco, Inc. brochure entitled "VOC Control Systems," 30 pages, 1996.

Wahlco Environmental Systems News Release entitled "Wahlco Environmental Licenses VOC Technology," Wahlco Press Release, 6 pages, 1995.

LTG Lufttechnische GmbH brochure entitled LTG Exhaust Air Purification Systems, 14 pages, (year unknown).

*Primary Examiner*—Teresa J. Walberg
*Assistant Examiner*—Tiping Lu
*Attorney, Agent, or Firm*—Senniger, Powers, Leavitt & Roedel

[57] ABSTRACT

A process and apparatus for oxidizing components of a feed gas mixture in a heat regenerative reactor are provided. The heat regenerative reactor comprises a vessel having a two ends, the interior of which defines an unfired heat exchange/reaction zone containing a gas-permeable bed comprising heat exchange material in which the components of the feed gas mixture are oxidized. A gas handling system selectively introduces the feed gas mixture into one end of the vessel and discharges reacted gas through the other end of the vessel such that the direction of gas flow through the vessel may be reversed. At the time of flow reversal, a bypass system introduces the feed gas mixture into the vessel at a point intermediate the two ends of the vessel so that the feed gas mixture bypasses a portion of the gas-permeable bed. During bypass, a purging system purges unreacted feed gas mixture from the heat exchange/reaction zone. The process and apparatus described herein provides for continuous processing of the feed gas mixture while avoiding the discharge of unreacted feed gas at the time of flow reversal.

34 Claims, 4 Drawing Sheets

PROCESS AND APPARATUS FOR OXIDIZING COMPONENTS OF A FEED GAS MIXTURE IN A HEAT REGENERATIVE REACTOR

BACKGROUND OF THE INVENTION

The present invention is directed to a process and an apparatus for oxidizing components of a feed gas mixture in a regenerative heat transfer reactor. The present invention may be used to oxidize contaminants contained in a variety of industrial gaseous effluents so as to sufficiently purify the gas for discharge to the environment.

A variety of systems are known for purifying waste gases by thermally or catalytically oxidizing contaminants contained in the gas. In heat regenerative systems, at least a portion of the energy required to heat the incoming waste gas to the temperature required for oxidation of the contaminants is supplied by regenerative heat exchange with the hot, purified gases. Such systems are characterized by at least one bed of heat exchange material through which the flow of gas is reversed such that the bed alternately preheats the incoming waste gas and collects heat from the hot, purified gas before it is exhausted from the system.

One of the primary problems with the design of regenerative heat transfer reactor systems is providing for continuous processing of the incoming gas while avoiding discharge of unreacted gas left in the bed of heat exchange material when the flow of gas through the system is reversed. Several solutions to this problem have been proposed.

In U.S. Pat. No. 3,870,474, Houston discloses a heat regenerative incinerator for thermally or catalytically oxidizing contaminants contained in a waste gas. In one embodiment, the incinerator includes at least three regenerator chambers filled with heat exchange material which communicate with a common, high temperature combustion chamber containing a burner. During a first phase of the process cycle, one of the regenerator chambers is used to preheat the incoming waste gas on its way to the combustion chamber, another of the regenerator chambers is heated by the purified gas flowing from the combustion chamber and the remaining regenerator chamber is purged of unreacted waste gas, the purged waste gas being directed ultimately into the combustion chamber for oxidation of the contaminants contained therein. In each successive phase of the cycle, the regenerator chamber previously heated by the purified gas is used to preheat the incoming waste gas, the regenerator chamber previously used to preheat the incoming gas is purged of residual waste gas, and the purified gas flowing from the combustion chamber is exhausted from the system through the regenerator chamber previously purged of unreacted waste gas. This approach to the problem of preventing the discharge of unreacted gas at the time of flow reversal, while allowing continuous processing of the waste gas, suffers from several disadvantages, including the increased cost, complexity, valving and space requirements associated with a system requiring three or more regenerator chambers.

Others have proposed solutions to the problem of discharge of unreacted gas from heat regenerative reactors at the time of flow reversal which do not require three or more regenerator chambers and yet still allow continuous processing of the incoming gas.

In U.S. Pat. No. 5,161,968, Nutcher, et al. disclose a heat regenerative thermal oxidizer for purifying contaminated fumes including, a high temperature incineration chamber and two regenerators filled with heat exchange material. Two burners, one associated with each regenerator, are directed into the incineration chamber. The two regenerators are in fluid communication with the incineration chamber through the associated burner. In operation, incoming fumes are preheated in one of the regenerators and flow into the incineration chamber through the associated burner as it is being operated in t-he firing mode. Oxidized fumes exit the incineration chamber through the other burner as it is being operated in the exhaust mode and flow through the other regenerator where heat is extracted from the oxidized fumes. The direction of gas flow through the system is periodically reversed so that each of the regenerators alternately preheats the incoming fumes while the associated burner is operated in the firing mode and extracts heat from the oxidized fumes exiting the incineration chamber while the associated burner is operated in the exhaust mode. At the time of flow reversal, the incoming fumes are bypassed around the regenerator being used to preheat the incoming fumes and this regenerator is purged of residual unburnt fumes by introducing a clean purge gas such as air or the oxidized fumes. The purged unburnt fumes and the bypassed incoming fumes are mixed at a point downstream of the purged regenerator and introduced into the incineration chamber through the firing burner and oxidized therein. Once the regenerator previously used to preheat the incoming fumes has been purged, the direction of gas flow through the oxidizer may be reversed without discharge of unburnt fumes.

In U.S. Pat. No. 5,163,829, Wildenberg discloses a heat regenerative thermal incinerator comprising a single vessel partitioned into two compartments, each compartment containing a bed of heat exchange material disposed below a combustion chamber fired by a burner. The incoming effluent is introduced at the bottom of the vessel and preheated as it flows upwardly through the heat exchange bed contained within one of the compartments. The preheated gas is incinerated as it flows through the combustion chamber and into the second compartment. The products of incineration flow downwardly through the second compartment, thereby transferring heat to the bed of heat exchange material contained therein before being discharged through the bottom of the vessel. The direction of gas flow through the vessel is reversed so that each of the heat exchange beds alternately preheats the incoming effluent and extracts heat from the incineration products. The mode of operation at the time of flow reversal is similar to that disclosed by Nutcher, et al. The incoming effluent is introduced directly into the combustion chamber at the top of the vessel, thereby bypassing the bed of heat exchange material being used to preheat the incoming effluent. During bypass, this heat exchange bed is purged of untreated effluent using the incineration products or other clean gas source as the purge gas. The purged untreated effluent and the bypassed incoming effluent are mixed within the combustion chamber and incinerated. Once purging is complete, the direction of gas flow through the vessel may be reversed without discharge of untreated effluent.

The systems proposed by Nutcher, et al. and Wildenberg suffer from several disadvantages. Both of these systems include a rather large void space within the apparatus which serves as an incineration or combustion chamber. In order to function effectively, the combustion chamber must be maintained at a temperature high enough to substantially completely react the contaminants and oxygen contained in the preheated waste gas as it passes through the chamber. In the thermal systems disclosed by Nutcher, et al. and Wildenberg, the combustion chamber is maintained at a temperature in excess of about 800° C. by operation of one or more burners positioned within or directed into the combustion chamber. This arrangement is disadvantageous since the burner is exposed to the high temperature environment of the combustion chamber and requires that the components of the burner be specially constructed of expensive, thermally resistant materials or that other precautions be taken to protect the burner from thermal damage. With respect to bypassing the incoming waste gas around the preheating regenerator at the time of flow reversal, both Nutcher, et al. and Wildenberg disclose introducing relatively cool bypassed gas into a combustion chamber free of heat retention material. Unless special precautions are taken, this practice causes rapid cooling of the gases within the combustion chamber which tends to quench the oxidation reaction and decrease the overall efficiency of the process. In order to avoid undue cooling of the combustion chamber, Nutcher et. al disclose mixing the bypassed incoming fumes and the preheated purge gas prior to introducing this mixture into the combustion chamber as well as increasing the firing rate of the burner through which this mixture is introduced into the incineration chamber. Wildenberg discloses providing a secondary mass of thermal storage media within the vessel between the inlet through which the bypassed incoming gas is introduced and the combustion chamber in order to elevate the temperature of the bypassed gas before it enters the combustion chamber. However, the need for such precautionary measures increases the cost and complexity of the apparatus and its operation.

SUMMARY OF THE INVENTION

Among the objects of the invention, therefore, may be noted the provision of a process and an apparatus for oxidizing the components of a feed gas mixture in a heat regenerative system; the provision of such a process and apparatus which may be used to oxidize contaminants in a feed gas mixture comprising an industrial waste gas effluent; the provision of a process and apparatus in which components of the feed gas mixture are oxidized in an unfired heat exchange/reaction zone; the provision of such a process and apparatus in which the feed gas mixture may be treated continuously by bypassing the incoming feed gas mixture around a portion of the heat exchange/reaction zone during a transitional step in the reversal of the direction of gas flow through the system; the provision of such a process and apparatus in which discharge of unreacted gas at the time of flow reversal is avoided by purging unreacted feed gas mixture from the bypassed portion of the heat exchange/reaction zone during the transitional step; and the provision of such a process and apparatus in which excessive cooling of the heat exchange/reaction zone by the incoming feed gas mixture during the transitional step is avoided so that the components of the feed gas mixture are oxidized to a high degree.

Briefly, therefore, the present invention is directed to a regenerative heat transfer reactor for oxidizing components of a feed gas mixture. The reactor comprises a vessel having two ends, the interior of the vessel defining an unfired heat exchange/reaction zone containing a gas-permeable bed comprising heat exchange material. The heat exchange material extends substantially throughout the heat exchange/reaction zone. The reactor further comprises a gas handling system, a bypass system, a purging system and a heater disposed externally of the vessel for supplying heat to the unfired heat exchange/reaction zone. The gas handling system selectively introduces the feed gas mixture into one of the ends of the vessel and discharges reacted gas comprising oxidized components of the feed gas mixture through the other end of the vessel such that each of the ends of the vessel alternately serves as an inlet for the feed gas mixture and as an outlet for the reacted gas and direction of gas flow through the vessel is reversed. The bypass system selectively introduces the feed gas mixture into the vessel at a point intermediate the ends of the vessel during a transitional step in reversing the direction of gas flow through the vessel. The bypass system comprises a bypass port on the vessel intermediate the ends of the vessel and in selective fluid communication with a bypass line connected to a source of the feed gas mixture. The purging system purges unreacted feed gas mixture from the unfired heat exchange/reaction zone during the transitional step such that the purged gas is reacted prior to being discharged from the reactor.

The present invention is further directed to a process for oxidizing components of a feed gas mixture in a regenerative heat transfer reactor as described above. The process comprises introducing the feed gas mixture into the vessel through one of the ends of the vessel, the feed gas mixture flowing into the gas-permeable bed and contacting the heat exchange material such that heat stored in the heat exchange material is transferred to the feed gas mixture and thereby heats the feed gas mixture. The components of the feed gas mixture are oxidized in the gas-permeable bed to produce reacted gas comprising the oxidized components of the feed gas mixture. The heat exchange material is contacted with the reacted gas such that heat is transferred from the reacted gas to the heat exchange material, thereby cooling the reacted gas. The cooled reacted gas is discharged from the vessel through the other end of the vessel. The direction of gas flow through the vessel is reversed in a continuing series of cycles by introducing the feed gas mixture into the other end of the vessel so that heat that has been transferred from the reacted gas to the heat exchange material is transferred to the feed gas mixture introduced into the vessel. As a transitional step in each complete reversal of the direction of gas flow through the vessel, the feed gas mixture is introduced into the vessel through the bypass port so that the feed gas mixture bypasses a portion of the gas-permeable bed. The feed gas mixture is then passed through the remainder of the gas-permeable bed downstream of the bypass port with respect to the direction of gas flow through the vessel so that the feed gas mixture is heated and maintained at a high enough temperature for a period of time sufficient to substantially completely oxidize the components of the feed gas mixture within the remainder of the gas-permeable bed. The reacted gas is discharged from the end of the vessel which served as the reacted gas outlet immediately prior to the transitional step. During the transitional step, unreacted feed gas mixture is purged from the unfired heat exchange/reaction zone between the end of the vessel which served as the reacted gas inlet immediately prior to the transitional step and the bypass port, the purged unreacted feed gas being combined with feed gas mixture being introduced into the vessel. During the process, heat is supplied to the unfired heat exchange/combustion zone by introducing a heated gas produced by the heater into the vessel.

Other objects and features of this invention will be in part apparent and in part pointed out hereinafter.

BRIEF DESCRIPTION OF THE DRAWINGS

Corresponding reference characters indicate corresponding parts throughout the drawings.

DETAILED DESCRIPTION OF THE PREFERRED EMBODIMENTS

In accordance with the present invention, an improved process and apparatus for oxidizing components of a feed gas mixture in a regenerative heat transfer reactor is provided. The present invention may be used to oxidize contaminants in a feed gas mixture comprising one or more of a wide variety of industrial waste gas effluents. For example, the present invention may be used to purify a feed gas mixture containing carbon monoxide and/or volatile organic compounds (VOCs) including, without limitation, solvents, gasoline vapors, paint fumes and chlorinated hydrocarbons, as well as other environmentally objectionable hydrocarbon substances. If the waste gas does not originally contain sufficient oxygen to support substantially complete oxidation of the contaminants contained therein, the oxygen content of the feed gas mixture may be supplemented by combining the waste gas with air or other oxygen source.

Figure 1:
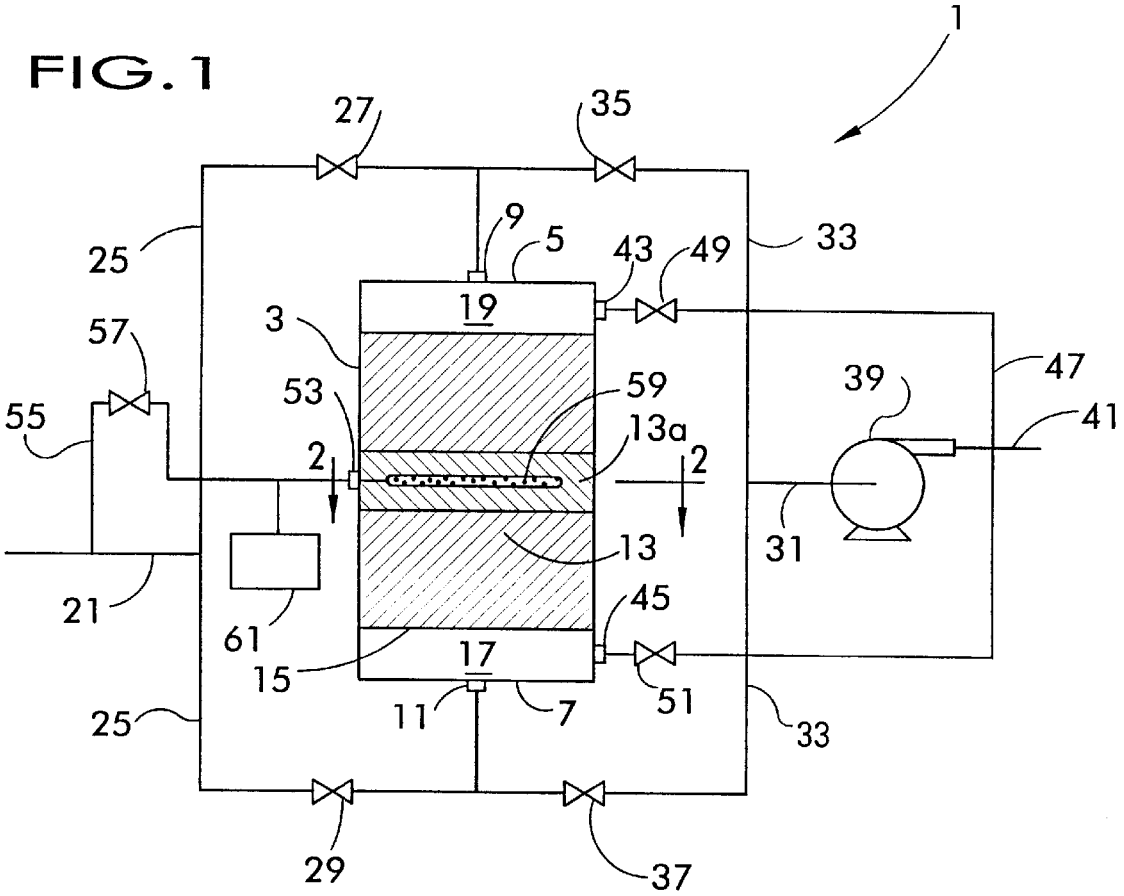
FIG. 1 schematically depicts a first embodiment of the reactor of the present invention.

A regenerative heat transfer reactor in accordance with a first embodiment of the present invention is shown schematically in FIG. 1. The reactor, generally designated by the numeral 1, comprises a single vertical vessel 3 having two ends, a first (upper) end 5 and a second (lower) end 7. Vessel 3 may suitably be a cylinder of circular cross-section having flat or dished ends. The upper and lower ends of the vessel are provided with gas ports 9 and 11, respectively.

The interior of vessel 3 defines a heat exchange/reaction zone containing a gas-permeable bed 13 comprising inert heat exchange material extending substantially throughout the heat exchange/reaction zone. Heat exchange materials should be capable of withstanding process temperatures and pressures, chemically inert with respect to the components of the feed gas mixture, and preferably have an average heat capacity greater than 0.15 cal/(gram·°C.), more preferably greater than 0.2 cal/(gram·°C.). Examples of suitable heat exchange materials include ceramics such as $SiO_2$ and $Al_2O_3$, stoneware, rocks and pebbles. Gas-permeable bed 13 may comprise random packing made of such heat exchange materials. The packing may have any desired shape, including saddles, spheres, cylinders and rings. Heat exchange materials in the form of packing preferably have a size between about 0.5 and 3 cm. An example of suitable heat exchange packing material is that sold under the trademark TY-PAK and available from Norton Chemical Process Products Corporation. Alternatively, all or a portion of gas-permeable bed 13 may be comprised of heat exchange material in the form of a monolithic (e.g., honeycomb) structure.

As shown in FIG. 1, bed 13 is supported within vessel 3 by a gas-permeable support 15 (e.g., an expanded metal grid) adjacent the lower end 7 of the vessel. In such an embodiment, a first distribution/collection zone 17 free of heat exchange material is defined within the vessel between the lower end thereof and the gas-permeable support. Furthermore, bed 13 need not extend completely to the upper end 5 of vessel 3 such that a second distribution/collection zone 19 free of heat exchange material is defined within the vessel between the upper end thereof and the upper surface of the gas-permeable bed. Distribution/collection zones 17 and 19 promote a relatively uniform flow of gas through the heat exchange/reaction zone and bed 13 and are preferred, especially in reactors comprising a vessel with a large cross section. However, it should be understood that a bed support is not required and that the gas-permeable bed may completely fill the interior of the vessel.

The heat regenerative reactor shown in FIG. 1 further comprises a gas handling system, a purging system and a bypass system. The gas handling system selectively introduces the feed gas mixture into one end of the vessel and discharges reacted gas comprising the oxidized components of the feed gas mixture through the other end of the vessel. Thus, each of the ends of the vessel alternately serves as an inlet for the feed gas mixture and as an outlet for the reacted gas and the direction of gas flow through the vessel is reversed. The purging system purges unreacted feed gas mixture from the heat exchange/reaction zone during a transitional step in reversing the direction of gas flow through the vessel so that unreacted feed gas mixture is not discharged from the reactor at the time of flow reversal. The bypass system selectively introduces the feed gas mixture into the vessel at a point intermediate the ends of the vessel during the transitional step so that treatment of the incoming feed gas mixture may proceed continuously. These systems, their components and operation are described in detail below.

A feed gas mixture supply line 21 is connected to a source of the feed gas mixture (not shown) and is in selective fluid communication with gas ports 9 and 11 at the ends of vessel 3 via line 25 and valves 27 and 29, respectively. Line 31 is likewise in selective fluid communication with gas ports 9 and 11 via line 33 and valves 35 and 37, respectively. Blower 39 provides the motive force for the flow of gas through the reactor and is connected to line 31 downstream of vessel 3 relative to the flow of reacted gas discharged from the vessel. Exhaust line 41 exiting blower 39 delivers reacted gas to a stack (not shown) or to further processing (e.g., heat recovery).

The purging system comprises purge ports 43 and 45 on vessel 3 adjacent the upper and lower ends of the vessel. Purge line 47 is connected to exhaust line 41 and is in selective fluid communication with purge ports 43 and 45 via valves 49 and 51, respectively.

The bypass system comprises bypass port 53 on vessel 3 at a point intermediate the upper and lower ends of the vessel. A bypass line 55 is connected to the source of the feed gas mixture and is in selective fluid communication with bypass port 53 via valve 57. Preferably, bypass port 53 is aligned on the vessel such that there are substantially equal volumetric proportions of heat exchange material within the heat exchange/reaction zone both above and below the bypass port. In order that gas introduced through bypass port 53 flow more uniformly through the heat exchange/reaction zone, it may be desirable to increase the void fraction in the portion of gas-permeable bed 13 adjacent the bypass port, for example, by utilizing heat exchange material having a larger average diameter. Furthermore, the bypass system may further comprise a gas distributor 59 in fluid communication with bypass port 53 for distributing gas introduced into vessel 3 through the bypass port within the heat exchange/reaction zone. Use of a gas distributor is especially advantageous in reactors with a large cross section to help provide uniform flow of gas through the heat exchange/reaction zone.

Figure 2:
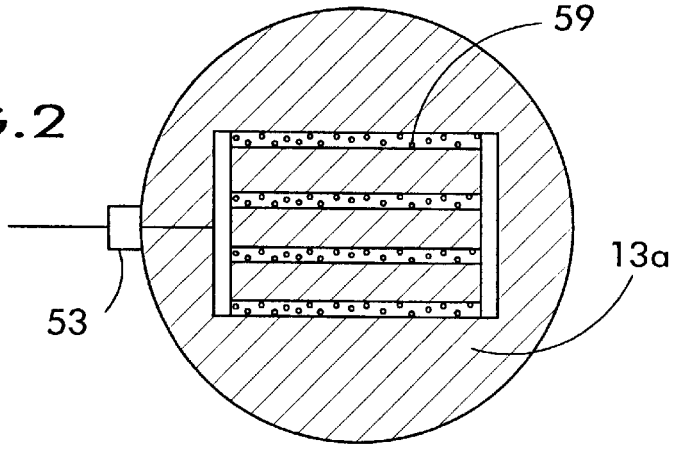
FIG. 2 is a cross-sectional view of the reactor shown in FIG. 1 taken along line 2—2.

FIG. 2 is a cross-sectional view of the reactor shown in FIG. 1 taken along line 2—2. As shown in FIGS. 1 and 2, gas distributor 59 may suitably comprise an array of heat-resistant perforated pipes disposed within bed 13 in contact with heat exchange material. If such an arrangement is employed, it is preferred that the portion of bed 13 adjacent gas distributor 59 comprise a structured, monolithic heat exchange material 13*a* to facilitate enhanced radial mixing of gas introduced into vessel 3 through bypass port 53. An example of a suitable structured heat exchange material for this purpose is the structured ceramic sold under the trademark FLEXERAMIC and available from Koch Engineering Co., Knight Division, Akron, Ohio.

As shown in FIG. 1, the bypass system and gas-permeable bed 13 are preferably constructed and arranged such that gas introduced into the vessel through the bypass system passes directly from the bypass system into the gas-permeable bed. However, it should be understood that other arrangements may be employed. For example, the heat exchange/reaction zone may contain a void zone free of heat exchange material in fluid communication with bypass port 53. In such an embodiment, gas introduced into the vessel through the bypass port is distributed by the void zone before contacting the heat exchange material.

The heat exchange/reaction zone defined by the interior of vessel 3 is unfired. As used herein, unfired heat exchange/reaction zone means that the interior of the vessel does not contain a heater (e.g., burner, electrical resistance heater, etc.) used to supply heat to the heat exchange/reaction zone. Rather, in accordance with the present invention, a heater disposed externally of vessel 3 is used to produce a heated gas outside of the vessel and the heated gas is introduced into the vessel to supply heat to the unfired heat exchange/reaction zone. An unfired heat exchange/reaction zone and external heater simplifies construction of the reactor since the heater does not have to be constructed to withstand the high temperature environment of the heat exchange/reaction zone. Preferably, as shown in FIG. 1, the external heater comprises a burner 61 which produces hot flue gases by combusting a suitable hydrocarbon fuel. The flow of hot flue gases produced by burner 61 may be introduced into vessel 3 via bypass line 55 and bypass port 53. In this manner, heat may be supplied to the unfired heat exchange/reaction zone as needed to maintain the temperature within the heat exchange/reaction zone at or above the minimum temperature necessary to substantially completely oxidize the contaminants in the feed gas mixture. Although use of an external burner is preferred, it should be understood that other external heating arrangements may be suitably employed to supply heat to the unfired heat exchange/reaction zone. For example, an electrical resistance heater located outside of the vessel may be contacted with a flow of gas (e.g., air, incoming feed gas mixture, etc.) and the heated gas introduced into the vessel. Furthermore, the heated gas produced by the external heater need not be introduced into the vessel through the bypass port, but may suitably be introduced at other points including through gas ports 9 and 11 at the ends of the vessel.

To initiate operation of the heat regenerative reactor shown in FIGS. 1 and 2, bed 13 within the unfired heat exchange/reaction zone is first preheated. Preheating of the bed may be suitably achieved by closing valves 27, 29, 49, 51 and 57 and opening valves 35 and 37. Once blower 39 has been activated, hot flue gases produced by burner 61 flow into vessel 3 through bypass line 55 and bypass port 53 and are distributed within the unfired heat exchange/reaction zone by gas distributor 59. The flow of hot flue gases entering vessel 3 splits into two part-streams, one flowing upwardly and the other flowing downwardly through gas-permeable bed 13 such that the heat exchange material in the bed is heated by direct heat transfer with the hot flue gases. Cooled flue gases exit vessel 3 through gas ports 9 and 11 and flow through open valves 35 and 37 and lines 33 and 31 before being exhausted from the reactor through blower 39 and exhaust line 41. The flow of flue gases through vessel 3 is continued for a time sufficient to preheat the gas-permeable bed within the unfired heat exchange/reaction zone to a temperature sufficient to ensure substantially complete oxidation of the contaminants contained in the feed gas mixture. In the case of noncatalytic (i.e., thermal) oxidation this typically requires preheating the gas-permeable bed to a temperature of at least about 650° C. Preferably, for noncatalytic oxidation, the bed is preheated to a temperature of from about 750° C. to about 800° C. Once the bed has been sufficiently preheated, treatment of the feed gas mixture may commence.

The phases of one cycle of a noncatalytic oxidation process in accordance with the present invention are now described with reference to the reactor shown in FIGS. 1 and 2. At the start of the first phase of the process cycle, valves 29 and 35 are opened and valves 27, 37, 49, 51 and 57 are closed. Open valves 29 and 35 allow blower 39 to draw the feed gas mixture into distribution/collection zone 17 within vessel 3 via supply line 21, line 25 and gas port 11. The feed gas mixture flows into gas-permeable bed 13 and contacts the heat exchange material such that previously stored heat is transferred to the feed gas mixture. Once the temperature of the feed gas mixture reaches the minimum temperature necessary to oxidize the contaminants, contaminants and oxygen in the feed gas mixture react within bed 13 as the gas continues to flow upwardly through vessel 3.

The contaminant destruction efficiency of the system is a function of both the temperature to which the incoming feed gas mixture is heated and the residence time of the gas within the gas-permeable bed. In order to substantially completely oxidize contaminants contained in the feed gas mixture, it is desirable to maintain the feed gas mixture at a temperature of at least about 650° C. for a period of at least about 0.1 seconds within bed 13. However, in some applications of the present invention, especially where a high destruction efficiency is desired, the residence time of feed gas mixture within the gas-permeable bed may be 1, 5 or even 10 or more seconds. If the feed mixture contains insufficient combustible content to achieve and maintain temperatures within the heat exchange/reaction zone required for satisfactory destruction of the contaminants and autothermal operation of the reactor, a hydrocarbon fuel and additional oxygen, if necessary, may be introduced into the vessel along with the feed gas mixture. For example, supplemental hydrocarbon fuel may be added to the feed gas mixture in supply line 21 or introduced into the vessel via bypass line 55 and bypass port 53. Additional heat may also be provided to the heat exchange/reaction zone by introducing hot flue gases produced by burner 61 into vessel 3 through bypass port 53. Apart from being necessary in some instances to maintain satisfactory destruction efficiency and autothermal operation of the reactor, introduction of supplemental fuel or a heated gas into the vessel may be desirable in some applications in order to reduce the volume of heat exchange material required within the heat exchange/reaction zone.

Reacted gas flows upwardly through vessel 3 contacting heat exchange material and transferring heat to bed 13.

Preferably, the bed is sized such that substantially complete oxidation of contaminants in the feed gas mixture occurs well before the gas traverses the bed. This allows a temperature profile to be established in the heat exchange/reaction zone characterized by a heat front or high temperature region generally occupying the middle portion of the bed and cooler regions generally occupying the portions of the bed near the ends of the vessel. The cooled reacted gas exits the bed and collects in distribution/collection zone 19 before being discharged from vessel 3 through gas port 9. Reacted gas flows through open valve 35 and lines 33 and 31 and is exhausted from the reactor through blower 39 and exhaust line 41.

After the heat exchange material within the portion of the bed adjacent distribution/collection zone 17 has been cooled to a preselected temperature, the heat exchange material within the portion of the bed adjacent distribution/collection zone 19 has been heated to a preselected temperature, or a prescribed period of time has elapsed, the direction of flow of gas through vessel 3 is reversed. However, in order to achieve flow reversal without discharging unreacted feed gas mixture from the reactor, a transitional step is required.

The transitional step is initiated by opening valve 57 and closing valve 29. This diverts the flow of feed gas mixture so that it enters vessel 3 through bypass line 55 and bypass port 53 thereby bypassing a portion of bed 13. The feed gas mixture is distributed within the heat exchange/reaction zone by gas distributor 59 and passes upwardly through the remainder of bed 13 downstream of bypass port 53 with respect to the direction of gas flow through vessel 3. As the feed gas mixture traverses the remainder of gas-permeable bed 13, it is heated by direct heat transfer with the heat exchange material and contaminants contained therein are oxidized. The reacted gas exits bed 13 and collects in distribution/collection zone 19 before being discharged from vessel 3 through gas port 9. Reacted gas flows through open valve 35 and lines 33 and 31 and is exhausted from the reactor through blower 39 and exhaust line 41.

In order to avoid an excessive decrease in contaminant destruction efficiency during the transitional step, the feed gas mixture introduced into vessel 3 through bypass port 53 should be heated and maintained at a high enough temperature for a period of time sufficient to substantially completely oxidize the components of the feed gas mixture within the remainder of bed 13. Desirably, the feed gas mixture introduced into the vessel through the bypass port is maintained at a temperature of at least about 650° C for a period of at least about 0.1 seconds before it traverses the remainder of the bed.

In accordance with the preferred embodiment of the present invention shown in FIG. 1, the bypass system and gas-permeable bed 13 are constructed and arranged such that gas introduced into the vessel through the bypass system passes directly from the bypass system into the gas-permeable bed. This practice assists in preventing excessive cooling of the heat exchange/reaction zone that might otherwise occur if the bypassed gas were introduced into a void space free of heat exchange material and thereby helps ensure that the bypassed gas is sufficiently heated. However, since the incoming feed gas mixture introduced into the vessel through the bypass port has bypassed a portion of bed 13, it may nevertheless be difficult to sufficiently heat the incoming feed gas mixture using only heat transferred from the remainder of the bed. In order to ensure adequate heating of the feed gas mixture introduced into the vessel through the bypass port during the transitional step, several other measures may also be employed, including increasing the volume of heat exchange material within the bed and allowing the portion of the bed adjacent the end of the vessel which served as the reacted gas outlet immediately prior to the transitional step to heat to a higher temperature before initiating the transitional step. Also, a supplemental hydrocarbon fuel and additional oxygen (if necessary) may be metered into the feed gas mixture to increase the exothermic temperature rise within the bed. Moreover, additional heat may provided to the unfired heat exchange/reaction zone during the transitional step by mixing hot flue gases produced by burner 61 with the feed gas mixture passing through bypass line 55 and introducing the heated mixture into the vessel through the bypass port.

Simultaneously with the introduction of feed gas mixture into bypass port 53, valve 51 is opened to allow a fraction of the flow of reacted gas in exhaust line 41 to be diverted back to vessel 3 via purge line 47. The diverted reacted gas displaces any residual feed gas mixture occupying distribution/collection zone 17 and the portion of gas-permeable bed 13 below bypass port 53. The displaced gas is directed upwardly through the bed until it is combined with feed gas mixture entering vessel 3 through bypass port 53. At this point, distribution/collection zone 17 and the portion of bed 13 below bypass port 53 is purged of unreacted feed gas and the flow of feed gas mixture through vessel 3 can be reversed without discharging unreacted feed gas mixture from the reactor.

To initiate the next phase of the cycle, valve 35 and valve 51 are closed and valve 37 is opened. The feed gas mixture entering vessel 3 through bypass port 53 is distributed within the heat exchange/reaction zone by gas distributor 59 and now flows in the opposite direction (i.e., downwardly) through bed 13 relative to the first phase of the process cycle. As the feed gas mixture passes through the remainder of bed 13 downstream of bypass port 53, it is heated by direct heat transfer with the heat exchange material and contaminants contained therein are oxidized. The reacted gas exits bed 13 and collects in distribution/collection zone 17 before being discharged from vessel 3 through gas port 11. Reacted gas flows through open valve 37 and lines 33 and 31 and is exhausted from the reactor through blower 39 and exhaust line 41. This third phase of the process prevents the discharge of unreacted feed gas mixture from the reactor which might occur if valves 27, 35 and 57 were stroked simultaneously. Although this third phase is preferred, it is not critical and may be omitted. In order to ensure adequate heating of the feed gas mixture as it traverses the portion of bed 13 below bypass port 53 during this third phase of the cycle, the measures described hereinabove, including the addition of a supplemental hydrocarbon fuel to the feed gas mixture and operation of burner 61 may be employed.

The fourth phase of the cycle is initiated by opening valve 27 and closing valve 57 to divert the flow of feed gas mixture from bypass line 55 to supply line 21, thereby completing the reversal of the flow of gas relative to the first phase of the process cycle. Feed gas mixture flows through lines 21 and 25, open valve 27, gas port 9, distribution/collection zone 19 and into bed 13. As the feed gas mixture flows downwardly through bed 13, heat is transferred from the bed 13 to the feed gas mixture and contaminants in the feed gas mixture are oxidized. The reacted gas continues to flow downwardly, contacting heat exchange material and transferring heat to the bed. The cooled reacted exits bed 13 and collects in distribution/collection zone 17 before being discharged from vessel 3 through gas port 11. Reacted gas flows through open valve 37 and lines 33 and 31 and is exhausted from the reactor through blower 39 and exhaust line 41.

After the heat exchange material within the portion of bed 13 adjacent distribution/collection zone 19 has been cooled to a preselected temperature, the heat exchange material within the portion of the bed adjacent distribution/collection zone 17 has been heated to a preselected temperature, or a prescribed period of time has elapsed, the direction of flow of gas through vessel 3 is again reversed in the fifth phase of the cycle. The fifth phase of the cycle is initiated by opening valve 57 and closing valve 27. This diverts the flow of feed gas mixture so that it enters vessel 3 through bypass line 55 and bypass port 53 and again bypasses a portion of bed 13. The feed gas mixture is distributed within the heat exchange/reaction zone by gas distributor 59 and passes downwardly through the remainder of bed 13 downstream of bypass port 53 with respect to the direction of gas flow through vessel 3. As the feed gas mixture traverses the remainder of gas-permeable bed 13 it is heated by direct heat transfer with the heat exchange material and contaminants contained therein are oxidized. The reacted gas exits bed 13 and collects in distribution/collection zone 17 before being discharged from vessel 3 through gas port 11. Reacted gas flows through open valve 37 and lines 33 and 31 and is exhausted from the reactor through blower 39 and exhaust line 41.

Simultaneously with the introduction of feed gas mixture into bypass port 53, valve 49 is opened to allow a fraction of the flow of reacted gas in exhaust line 41 to be diverted to vessel 3 via purge line 47. The diverted reacted gas displaces any residual feed gas mixture occupying distribution/collection zone 19 and the portion of gas-permeable bed 13 above bypass port 53, directing the displaced gas downwardly through the bed until it is combined with feed gas mixture entering vessel 3 through the bypass port. At this point, distribution/collection zone 19 and the portion of bed 13 above gas distributor 59 is purged of unreacted feed gas and the flow of feed gas mixture through vessel 3 can be reversed without discharging unreacted feed gas mixture from the reactor.

To initiate the final phase of the cycle, valve 37 and valve 49 are closed and valve 35 is opened. The feed gas mixture entering vessel 3 through bypass port 53 is distributed within the heat exchange/reaction zone by gas distributor 59 and now flows in the opposite direction (i.e., upwardly) through bed 13 relative to the fourth phase of the process cycle. As the feed gas mixture passes through the remainder of bed 13 downstream of bypass port 53, it is heated by direct heat transfer with the heat exchange material and contaminants contained therein are oxidized. The reacted gas exits bed 13 and collects in distribution/collection zone 19 before being discharged from vessel 3 through gas port 9. Reacted gas flows through open valve 35 and lines 33 and 31 and is exhausted from the reactor through blower 39 and exhaust line 41. This sixth and final phase of the process cycle prevents the discharge of unreacted feed gas mixture from the reactor which might occur if valves 29, 37 and 57 were stroked simultaneously. Like the third phase, this final phase is preferred, but is not critical and may be omitted.

Opening valve 29 and closing valve 57 to divert feed gas mixture from bypass line 55 to supply line 21 begins a new cycle of the process.

The valve positions in each of the six phases of the process described above are summarized in Table I. "Valve time" as used in Table I and the succeeding tables means the amount of time for mechanical repositioning of the valve from one position to another to divert the flow of gas.

TABLE I

| | | VALVE NO. | | | | | | | |
|---|---|---|---|---|---|---|---|---|---|
| PHASE | DESCRIPTION | 27 | 29 | 35 | 37 | 49 | 51 | 57 | TIME |
| 1 | Up Flow of Gas/no Purge | C | O | O | C | C | C | C | 1.5–30 min (typical) |
| 2 | Bypass Flow Up with Purge | C | C | O | C | C | O | O | 1–50% of phase 1 |
| 3 | Bypass Flow Down/no Purge | C | C | C | O | C | C | O | Valve Time +0.25 Sec. |
| 4 | Down Flow of Gas/no Purge | O | C | C | O | C | C | C | 1.5–30 min (typical) |
| 5 | Bypass Flow Down with Purge | C | C | C | O | O | C | O | 1–50% of phase 4 |
| 6 | Bypass Flow Up/no Purge | C | C | O | C | C | C | O | Valve Time +0.25 Sec. |

O: Open
C: Closed

The amount of time required for one complete cycle of the process of the present invention varies depending upon a variety of factors including the type and concentration of contaminants contained in the feed gas mixture. Generally, however, a complete cycle will consume from about 0.8 to about 100 minutes, with cycle times of approximately 2 to 10 minutes being typical. Optimally, a substantial fraction, that is, at least about 95%, of the time required for a cycle will be devoted to the first and fourth phases of the process described above. Thus, the transitional steps between complete flow reversals preferably require no more than about 5% of the time required for a cycle. Also, it is desirable that the flow rate of purge gas diverted back to vessel 3 via line 43 during the second and fifth phases of the cycle be less than about 50%, preferably about 15–25%, of the flow rate of feed gas mixture entering the reactor.

Figure 3:
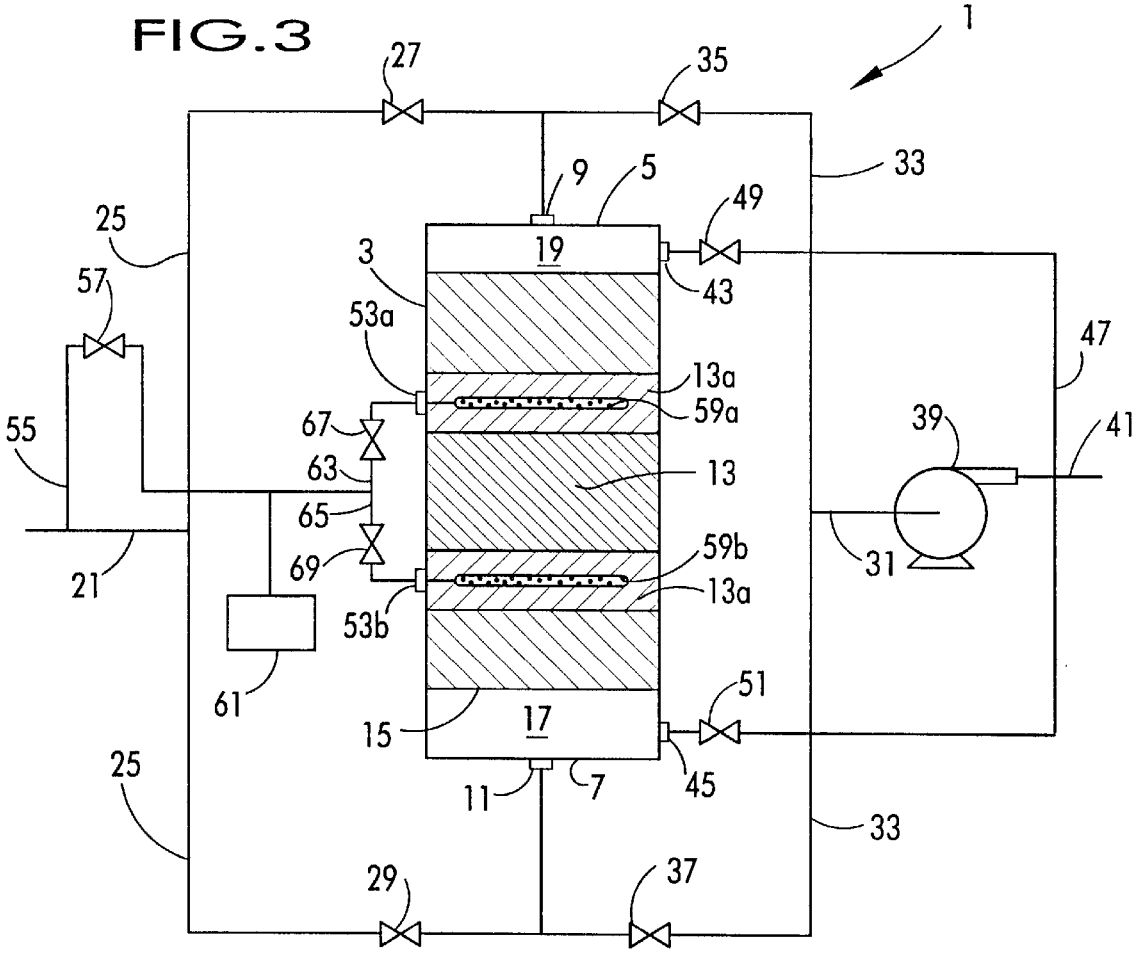
FIG. 3 schematically depicts a first alternative embodiment of the reactor of the present invention.

A first alternative embodiment of a reactor in accordance with the present invention is schematically depicted in FIG. 3. The construction of this alternative embodiment is identical to the reactor shown in FIG. 1 except that instead of a single bypass port, the bypass system comprises first and second bypass ports 53*a* and 53*b* on vessel 3. Bypass ports 53*a* and 53*b* are positioned intermediate the ends of vessel 3 and are off-set from the vertical center of the vessel such that bypass port 53*a* is positioned closer to upper end 5 of the vessel and bypass port 53*b* is positioned closer to lower end 7 of the vessel. Bypass ports 53*a* and 53*b* are each in selective fluid communication with bypass line 55 via lines 63 and 65 and valves 67 and 69, respectively. As shown in FIG. 3, the bypass system and gas-permeable bed 13 are preferably constructed and arranged such that gas introduced into the vessel through the bypass system passes directly from the bypass system into the gas-permeable bed. The bypass system may further comprise gas distributors 59*a* and 59*b* associated with bypass ports 53*a* and 53*b*, respectively, and disposed within the bed in contact with heat exchange material. Preferably, the gas-permeable bed comprises a structured packing material 13*a* adjacent gas distributors 59*a* and 59*b* to facilitate radial mixing of gas introduced into vessel 3 through the bypass ports.

Operation of the reactor shown in FIG. 3 proceeds as described above for the reactor shown in FIG. 1 except that during the transitional step, the feed gas mixture is introduced into vessel 3 through the bypass port nearest the end of the vessel which served as the reacted gas inlet immediately prior to the transitional step. Also, during the transitional step, unreacted feed gas mixture is purged from the heat exchange/reaction zone between the end of the vessel which served as the reacted gas inlet immediately prior to the transitional step and the bypass port through which the feed gas mixture is being introduced. Preferably, the volume of heat exchange material within the heat exchange/reaction zone between bypass ports 53*a* and 53*b* is sufficient such that contaminants within the feed gas mixture introduced through the bypass ports are substantially oxidized within this volume. Desirably, the feed gas mixture introduced into the vessel through bypass ports 53*a* and 53*b* is maintained at a temperature of at least about 650° C. for a period of at least about 0.1 seconds within the volume of heat exchange material between the two bypass ports. By introducing feed gas mixture into vessel 3 at points off-set from the vertical center of the vessel (i.e., the high temperature region of the heat exchange/reaction zone) during the transitional step, the propensity of relatively cool feed gas mixture to quench the oxidation reaction is reduced. This configuration may be particularly useful in applications requiring a high overall contaminant destruction efficiency.

The valve positions in each of the six phases of the process conducted with respect to this first alternative embodiment of the reactor of the present invention are summarized in Table II. Although valves 67 and 69 are shown in Table II as being closed during phases 1 and 4 of the process, it should be understood that these valves could be open during phases 1 and 4 to provide additional heat to the heat exchange/reaction zone by introducing hot flue gases produced by burner 61 into vessel 3 through bypass ports 53*a* and 53*b*. Preferably, if such measures are employed, hot flue gases are introduced into the vessel through bypass port 53*b* by opening valve 69 during phase 1 and through bypass port 53*a* by opening valve 67 during phase 4.

TABLE II

| | | VALVE NO. | | | | | | | | | |
|---|---|---|---|---|---|---|---|---|---|---|---|
| PHASE | DESCRIPTION | 27 | 29 | 35 | 37 | 49 | 51 | 57 | 67 | 69 | TIME |
| 1 | Up Flow of Gas/no Purge | C | O | O | C | C | C | C | C | C | 1.5–30 min (typical) |
| 2 | Bypass Flow Up with Purge | C | C | O | C | C | O | O | C | O | 1–50% of phase 1 |
| 3 | Bypass Flow Down/no Purge | C | C | C | O | C | C | O | O | C | Valve Time +0.25 Sec. |
| 4 | Down Flow of Gas/no Purge | O | C | C | O | C | C | C | C | C | 1.5–30 min (typical) |
| 5 | Bypass Flow Down with Purge | C | C | C | O | O | C | O | O | C | 1–50% of phase 4 |
| 6 | Bypass Flow Up/no Purge | C | C | O | C | C | C | O | C | O | Valve Time +0.25 Sec. |

O: Open
C: Closed

Figure 4:
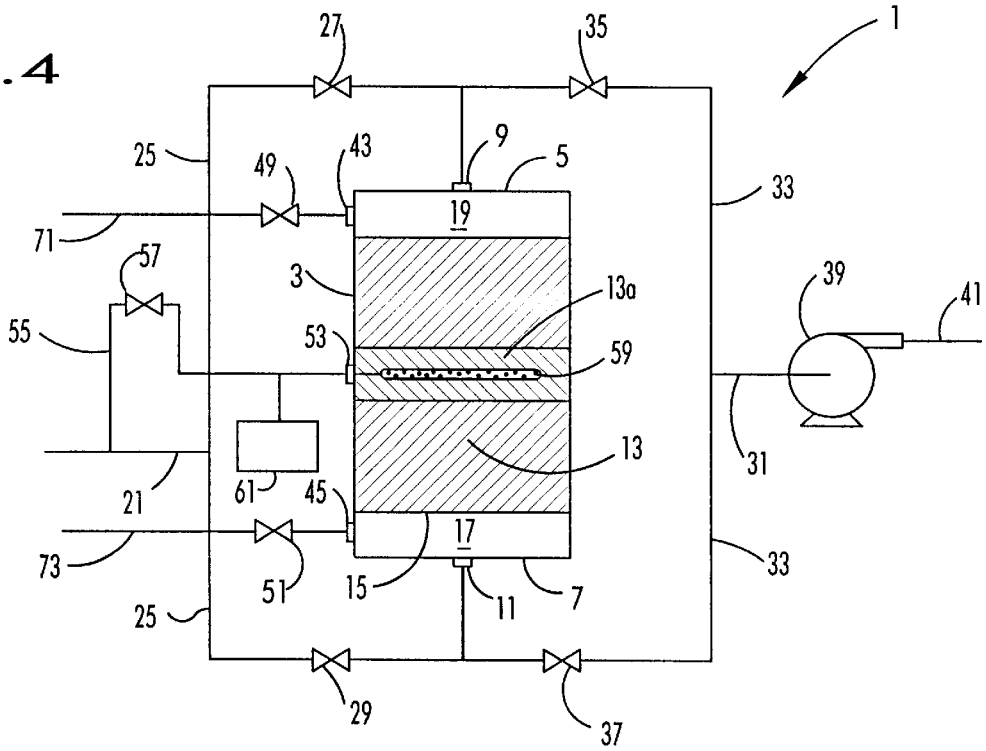
FIG. 4 schematically depicts a second alternative embodiment of the reactor of the present invention.

A second alternative embodiment of a reactor of the present invention is schematically depicted in FIG. 4. The construction and operation of this alternative embodiment is identical to the reactor shown in FIG. 1 except that instead of displacing unreacted feed gas mixture from the heat exchange/reaction zone during the transitional step using reacted gas, a purge gas such as air, carbon dioxide, or other gas free of contaminants is used. The purge gas is introduced into vessel 3 through purge ports 43 and 45 via lines and 71 and 73, respectively, the latter being connected to a source of the purge gas (not shown).

The valve positions in each of the six phases of the process conducted with respect to this second alternative embodiment of the reactor of the present invention are summarized in Table III.

TABLE III

| | | VALVE NO. | | | | | | | |
|---|---|---|---|---|---|---|---|---|---|
| PHASE | DESCRIPTION | 27 | 29 | 35 | 37 | 49 | 51 | 57 | TIME |
| 1 | Up Flow of Gas/no Purge | C | O | O | C | C | C | C | 1.5–30 min (typical) |
| 2 | Bypass Flow Up with Purge | C | C | O | C | C | O | O | 1–50% of phase 1 |
| 3 | Bypass Flow Down/no Purge | C | C | C | O | C | C | O | Valve Time +0.25 Sec. |
| 4 | Down Flow of Gas/no Purge | O | C | C | O | C | C | C | 1.5–30 min (typical) |
| 5 | Bypass Flow Down with Purge | C | C | C | O | O | C | O | 1–50% of phase 4 |
| 6 | Bypass Flow Up/no Purge | C | C | O | C | C | C | O | Valve Time +0.25 Sec. |

O: Open
C: Closed

Figure 5:
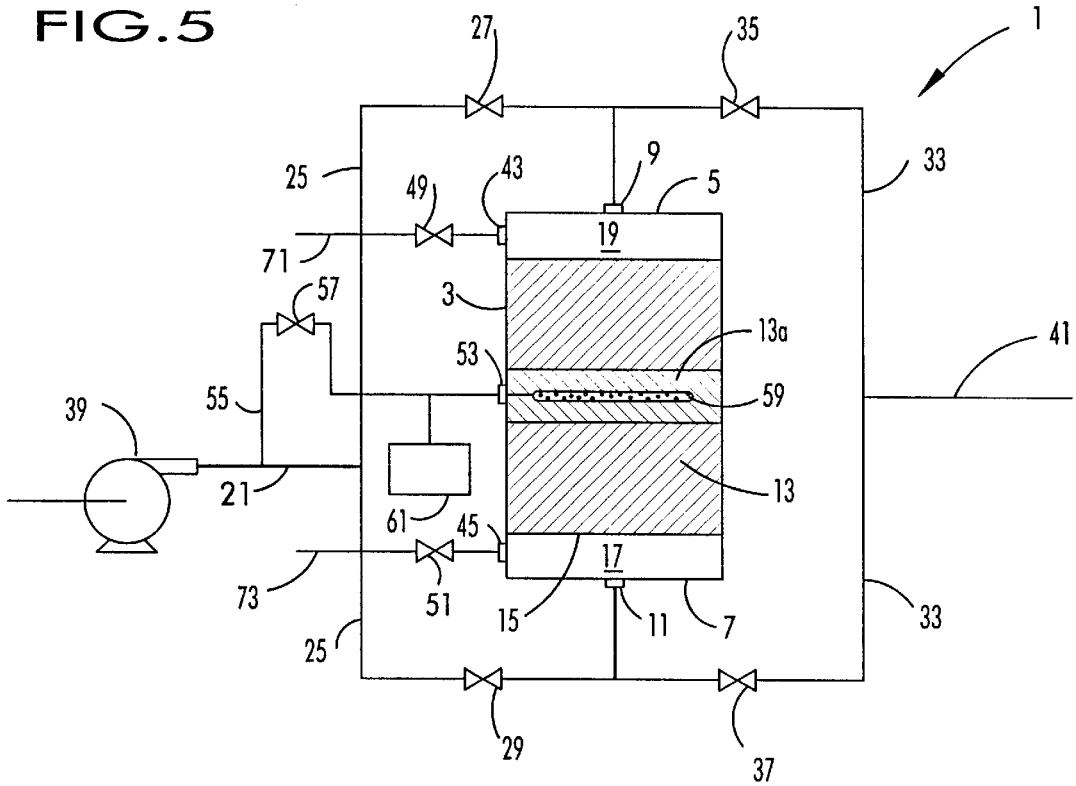
FIG. 5 schematically depicts a third alternative embodiment of the reactor of the present invention.

A third alternative embodiment of a reactor of the present invention is schematically depicted in FIG. 5. The construction and operation of this alternative embodiment is identical to the reactor shown in FIG. 4 except that blower 39 is connected to a source of the feed gas mixture and to supply line 21 upstream of vessel 3 relative to the flow of feed gas mixture introduced into the vessel.

The valve positions in each of the six phases of the process conducted with respect to this third alternative embodiment of the reactor of the present invention are summarized in Table IV.

TABLE IV

| PHASE | DESCRIPTION | VALVE NO. 27 | 29 | 35 | 37 | 49 | 51 | 57 | TIME |
|---|---|---|---|---|---|---|---|---|---|
| 1 | Up Flow of Gas/no Purge | C | O | O | C | C | C | C | 1.5–30 min (typical) |
| 2 | Bypass Flow Up with Purge | C | C | O | C | C | O | O | 1–50% of phase 1 |
| 3 | Bypass Flow Down/no Purge | C | C | C | O | C | C | O | Valve Time +0.25 Sec. |
| 4 | Down Flow of Gas/no Purge | O | C | C | O | C | C | C | 1.5–30 min (typical) |
| 5 | Bypass Flow Down with Purge | C | C | C | O | O | C | O | 1–50% of phase 4 |
| 6 | Bypass Flow Up/no Purge | C | C | O | C | C | C | O | Valve Time +0.25 Sec. |

O: Open
C: Closed

Figure 6:
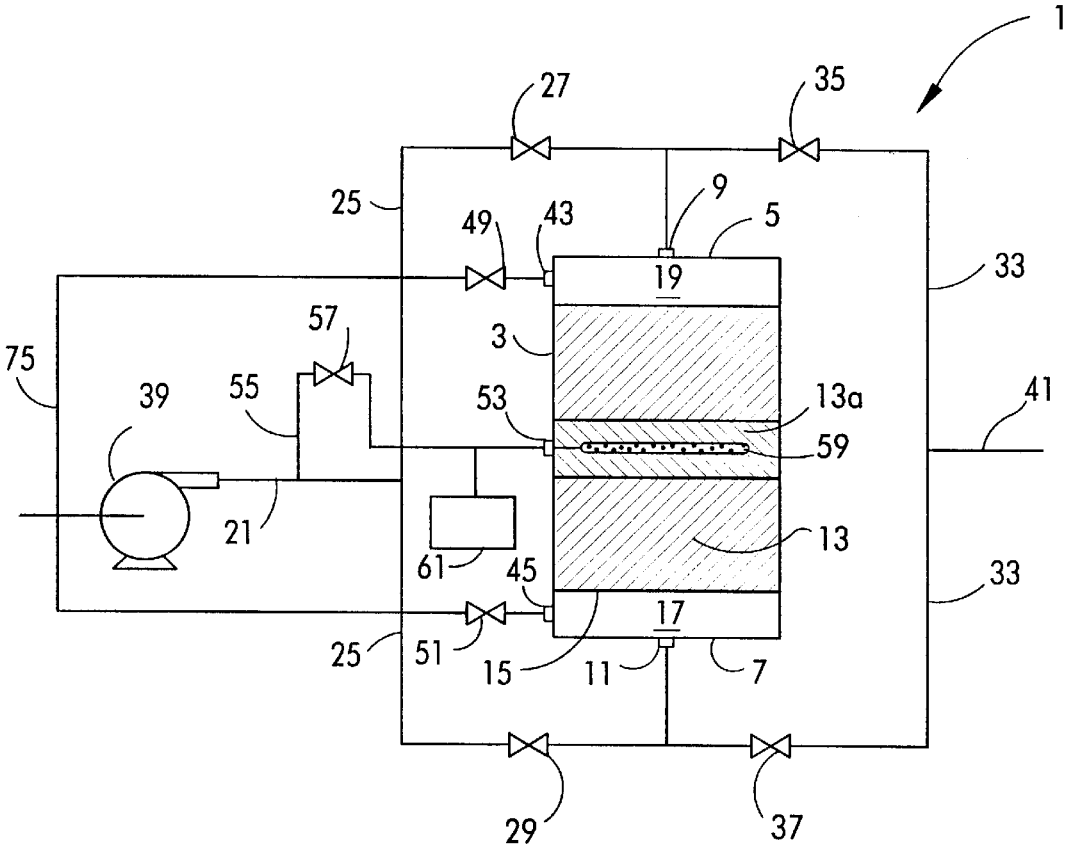
FIG. 6 schematically depicts a fourth alternative embodiment of the reactor of the present invention.

A fourth alternative embodiment of a reactor in accordance with the present invention is schematically depicted in FIG. 6. Like the embodiment shown in FIG. 5, blower 39 is connected to a source of the feed gas mixture and to supply line 21 upstream of vessel 3 relative to the flow of feed gas mixture introduced into the vessel. However, in this alternative embodiment, purging of the heat exchange/reaction zone during the transitional step is achieved by splitting the flow of feed gas mixture introduced through bypass port 53 and using a portion of the flow of reacted gas to displace unreacted feed gas mixture from vessel 3. The displaced unreacted feed gas is recirculated and combined with feed gas mixture being introduced through bypass port 53 so that it is reacted prior to being discharged from the reactor.

The phases of one cycle of the process in accordance with the present invention are now described with reference to the reactor shown in FIG. 6.

In the first phase of the process cycle, valves 29 and 35 are opened and valves 27, 37, 49, 51 and 57 are closed. Thus, incoming feed gas mixture is delivered by blower 39 to distribution/collection zone 17 within vessel 3 via supply line 21, line 25 and gas port 11. Feed gas mixture flows upwardly through gas-permeable bed 13 and reacted gas collects in distribution/collection zone 19 before being discharged from vessel 3 through gas port 9. Reacted gas flows through open valve 35 and is exhausted from the reactor through line 33 and exhaust line 41.

In the second phase of the process cycle, valves 51 and 57 are opened and valve 29 is closed. This diverts the flow of feed gas mixture so that it enters vessel 3 through bypass line 55 and bypass port 53. The feed gas mixture is distributed within the heat exchange/reaction zone by gas distributor 59 and is split into two part-streams. A first part-stream which constitutes at least about 50%, preferably about 75–85%, of the flow of feed gas mixture introduced into bypass port 53, flows upwardly through bed 13 where it is heated by heat exchange material and the contaminants contained therein are oxidized. The reacted gas exits bed 13 and collects in distribution/collection zone 19 before being discharged from vessel 3 through gas port 9. Reacted gas flows through open valve 35 and is exhausted from the reactor through line 33 and exhaust line 41. The other part-stream, which constitutes the remainder of the flow of feed gas mixture introduced into vessel 3 through bypass port 53, flows downwardly through bed 13 where it is heated by heat exchange material and the contaminants contained therein are oxidized. The reacted gas continues to flow downwardly through bed 13, displacing any residual unreacted feed gas mixture trapped in the bed below bypass port 53 and in distribution/collection zone 17. The displaced unreacted feed gas is directed from vessel 3 through purge port 45 and combined with feed gas mixture in line 21 via valve 51, recirculation line 75 and blower 39. At this point, distribution/collection zone 17 is purged of unreacted feed gas and the flow of feed gas mixture through vessel 3 can be reversed without discharging unreacted feed gas from the reactor.

To initiate the third phase, valves 35 and valve 51 are closed and valve 37 is opened. The feed gas mixture entering vessel 3 through bypass port 53 flows downwardly through bed 13. Reacted gas exits bed 13 and collects in distribution/collection zone 17 before being discharged from vessel 3 through gas port 11. Reacted gas flows through open valve 37 and is exhausted from the reactor through line 33 and exhaust line 41.

The fourth phase of the process cycle is initiated by opening valve 27 and closing valve 57 to divert the flow of feed gas mixture from bypass line 55 to supply line 21. This results in a complete reversal of the flow of gas relative to the first phase of the process.

In the fifth phase of the process, valves 49 and 57 are opened and valve 27 is closed. This diverts the flow of feed gas mixture so that it enters vessel 3 through bypass line 55 and bypass port 53. The feed gas mixture is distributed within the heat exchange/reaction zone by gas distributor 59 and is split into two part-streams. The first part-stream flows downwardly through bed 13 where it is heated by heat exchange material and the contaminants contained therein are oxidized. The reacted gas exits bed 13 and collects in distribution/collection zone 17 before being discharged from vessel 3 through gas port 11. Reacted gas flows through open valve 37 and is exhausted from the reactor through line 33 and exhaust line 41. The other part-stream, which constitutes the remainder of the flow of feed gas mixture introduced into vessel 3 through bypass port 53, flows upwardly through bed 13 where it is heated by heat exchange material and the contaminants contained therein are oxidized. The reacted gas continues to flow upwardly through bed 13, displacing any residual unreacted feed gas mixture trapped in the bed above bypass port 53 and in distribution/collection zone 19. The displaced unreacted feed gas is directed from vessel 3 through purge port 43 and combined with feed gas mixture in line 21 via valve 49, recirculation line 75 and blower 39. At this point, distribution/collection zone 19 is purged of unreacted feed gas and the flow of feed gas mixture through vessel 3 can be reversed without discharging unreacted feed gas from the reactor.

In the sixth and final phase of the process cycle, valve 37 and valve 49 are closed and valve 35 is open. The feed gas mixture entering vessel 3 through bypass port 53 flows upwardly through bed 13. Reacted gas exits bed 13 and collects in distribution/collection zone 19 before being discharged from vessel 3 through gas port 9. Reacted gas flows through open valve 35 and is exhausted from the reactor through line 33 and exhaust line 41.

Closing valve 57 and opening valve 29 to divert feed gas mixture from bypass line 55 to line 21 begins a new cycle of the process.

The valve positions in each of the six phases of the process conducted with respect to this fourth alternative embodiment of the reactor of the present invention are summarized in Table V.

TABLE V

| PHASE | DESCRIPTION | VALVE NO. 27 | 29 | 35 | 37 | 49 | 51 | 57 | TIME |
|---|---|---|---|---|---|---|---|---|---|
| 1 | Up Flow of Gas/no Purge | C | O | O | C | C | C | C | 1.5–30 min (typical) |
| 2 | Bypass Flow Up with Purge | C | C | O | C | C | O | O | 1–50% of phase 1 |
| 3 | Bypass Flow Down/no Purge | C | C | C | O | C | C | O | Valve Time +0.25 Sec. |
| 4 | Down Flow of Gas/no Purge | O | C | C | O | C | C | C | 1.5–30 min (typical) |
| 5 | Bypass Flow Down with Purge | C | C | C | O | O | C | O | 1–50% of phase 4 |
| 6 | Bypass Flow Up/no Purge | C | C | O | C | C | C | O | Valve Time +0.25 Sec. |

O: Open
C: Closed

As illustrated in FIGS. 1–6, the heat exchange/reaction zone is defined by a vertical vessel and the gas flows in a substantially vertical direction (up or down) through the gas-permeable bed. Alternatively, the heat exchange/reaction zone could be defined by a horizontal vessel and the flow of gas could be substantially horizontal (left or right) through the gas-permeable bed. In a further alternative, the heat exchange/reaction zone could be defined by a housing comprising two side-by-side vertical vessels connected through a horizontal cross-over piece having one or more bypass ports.

The valves of the reactor are shown in the accompanying drawings as comprising two-way valves. However, it should be understood that these valves could suitably be replaced by approximate combination of three-way valves or four-way valves.

The process has been described above as a noncatalytic (i.e., thermal) process in which high temperature processing is required to oxidize contaminants contained in the feed gas mixture. However, if lower temperature processing is desired, the heat exchange material may comprise catalyst to promote the oxidation of contaminants in the feed gas mixture. The catalyst should also be capable of withstanding process temperatures and pressures. Desirably, most impurities will not chemically bond to the catalyst surface. Suitable oxidation catalysts include metal oxides and typical noble metal catalysts such as platinum and palladium. Like the inert heat exchange material, the catalyst may be in the form of packing of various shapes or be of monolithic structure. When a catalyst is employed, layers of catalyst are preferably interposed between layers of inert heat exchange material within the gas-permeable bed in order to avoid rapid cooling and heating of the catalyst. Process temperatures for catalytic oxidation of components of the feed gas mixture will vary with the composition of the feed gas and the catalyst employed, but will generally be significantly lower than those encountered in thermal processing. Typically, process temperatures for catalytic oxidations will be from about 150° C. to about 700° C.

In view of the above, it will be seen that the several objects of the invention are achieved.

As various changes could be made in the above processes and apparatus without departing from the scope of the invention, it is intended that all matter contained in the above description be interpreted as illustrative and not in a limiting sense.

What is claimed is:

1. A regenerative heat transfer reactor for oxidizing components of a feed gas mixture, the reactor comprising:

a vessel having two ends, the interior of said vessel defining an unfired heat exchange/reaction zone containing a gas-permeable bed comprising heat exchange material, said heat exchange material extending substantially throughout said heat exchange/reaction zone;

a gas handling system for selectively introducing the feed gas mixture into one of said ends of said vessel and discharging reacted gas comprising oxidized components of the feed gas mixture through the other of said ends of said vessel such that each of said ends of said vessel alternately serves as an inlet for the feed gas mixture and as an outlet for the reacted gas and direction of gas flow through said vessel is reversed;

a bypass system for selectively introducing the feed gas mixture into said vessel at a point intermediate said ends of said vessel during a transitional step in reversing the direction of gas flow through said vessel, said bypass system comprising a bypass port on said vessel intermediate said ends of said vessel and in selective fluid communication with a bypass line connected to a source of the feed gas mixture;

a purging system for purging unreacted feed gas mixture from said unfired heat exchange/reaction zone during the transitional step, said purged gas being reacted prior to being discharged from the reactor; and a heater disposed externally of said vessel for supplying heat to said unfired heat exchange/reaction zone.

2. A reactor as set forth in claim 1 wherein said heater produces a heated gas outside of said vessel, the heated gas being introduced into said vessel to supply heat to said unfired heat exchange/reaction zone.

3. A reactor as set forth in claim 2 wherein said heater comprises a burner which produces hot flue gases by combusting a suitable hydrocarbon fuel, said heated gas introduced into said vessel to supply heat to said unfired heat exchange/reaction zone comprising said hot flue gases.

4. A reactor as set forth in claim 2 wherein the heated gas produced by said heater is introduced into said vessel through said bypass port.

5. A reactor as set forth in claim 1 wherein said bypass system and said gas-permeable bed are constructed and arranged such that feed gas mixture introduced into said vessel through said bypass system passes directly from said bypass system into said gas-permeable bed.

6. A reactor as set forth in claim 5 wherein said bypass system further comprises a gas distributor in fluid communication with said bypass port for distributing the feed gas mixture introduced into said vessel through said bypass system within said unfired heat exchange/reaction zone, said gas distributor being disposed within said gas-permeable bed in contact with said heat exchange material.

7. A reactor as set forth in claim 6 wherein said gas distributor comprises an array of perforated pipes.

8. A reactor as set forth in claim 6 wherein said gas-permeable bed comprises structured packing material adjacent said gas distributor.

9. A reactor as set forth in claim 1 wherein said bypass port of said bypass system comprises a first bypass port, said bypass system further comprising a second bypass port on said vessel intermediate said ends of said vessel and in selective fluid communication with said bypass line, said bypass ports being off-set from the center of said vessel such that said first bypass port is positioned closer to one end of said vessel and said second bypass port is positioned closer to the other end of said vessel.

10. A reactor as set forth in claim 9 wherein said bypass system and said gas-permeable bed are constructed and arranged such that feed gas mixture introduced into said vessel through said bypass system passes directly from said bypass system into said gas-permeable bed.

11. A reactor as set forth in claim 10 wherein said bypass system further comprises a first gas distributor in fluid communication with said first bypass port and a second gas distributor in fluid communication with said second bypass port for distributing the feed gas mixture introduced into said vessel through said bypass system within said unfired heat exchange/reaction zone, said gas distributors being disposed within said gas-permeable bed in contact with said heat exchange material.

12. A reactor as set forth in claim 11 wherein each of said gas distributors comprises an array of perforated pipes.

13. A reactor as set forth in claim 11 wherein said gas-permeable bed comprises structured packing material adjacent each of said gas distributors.

14. A reactor as set forth in claim 1 further comprising a blower downstream of said vessel relative to the flow of reacted gas exiting said vessel, said purging system diverting a fraction of the flow of reacted gas discharged from said vessel back to said vessel during the transitional step such that the diverted reacted gas is used to purge unreacted feed gas from said unfired heat exchange/reaction zone.

15. A reactor as set forth in claim 1 wherein said heat exchange material comprises catalyst.

16. A reactor as set forth in claim 15 wherein said gas-permeable bed comprises a layer of catalyst interposed between layers of inert heat exchange material.

17. A process for oxidizing components of a feed gas mixture in a regenerative heat transfer reactor, the reactor comprising a vessel having two ends, the interior of said vessel defining an unfired heat exchange/reaction zone containing a gas-permeable bed comprising heat exchange material, said heat exchange material extending substantially throughout said heat exchange/reaction zone, the reactor further comprising a heater disposed externally of said vessel for producing a heated gas outside of said vessel and a bypass system comprising a bypass port on said vessel intermediate said ends of said vessel and in selective fluid communication with a bypass line connected to a source of the feed gas mixture, the process comprising:

supplying heat to said unfired heat exchange/reaction zone by introducing heated gas produced by said heater into said vessel;

introducing the feed gas mixture into said vessel through one of said ends of said vessel, the feed gas mixture introduced into said vessel flowing into said gas-permeable bed and contacting said heat exchange material such that heat stored in said heat exchange material is transferred to the feed gas mixture and thereby heats the feed gas mixture;

oxidizing components of the feed gas mixture in said gas-permeable bed to produce reacted gas comprising the oxidized components of the feed gas mixture;

contacting said heat exchange material with the reacted gas such that heat is transferred from the reacted gas to said heat exchange material and thereby cools the reacted gas;

discharging the cooled reacted gas from said vessel through the other of said ends of said vessel;

reversing the direction of gas flow through said vessel in a continuing series of cycles by introducing the feed gas mixture into said other end of said vessel so that heat that has been transferred from the reacted gas to said heat exchange material is transferred to the feed gas mixture introduced into said vessel; and as a transitional step in each complete reversal of the direction of gas flow through said vessel, introducing the feed gas mixture into said vessel through said bypass port so that the feed gas mixture bypasses a portion of said gas-permeable bed, passing feed gas mixture through the remainder of said gas-permeable bed downstream of said bypass port with respect to the direction of gas flow through said vessel, feed gas mixture introduced into said vessel through said bypass port being heated and maintained at a high enough temperature for a period of time sufficient to substantially completely oxidize the components of the feed gas mixture within the remainder of said gas-permeable bed, discharging reacted gas from the end of said vessel which served as the reacted gas outlet immediately prior to the transitional step, purging unreacted feed gas mixture from said unfired heat exchange/reaction zone between the end of said vessel which served as the feed gas mixture inlet immediately prior to the transitional step and said bypass port, and combining the purged unreacted feed gas with feed gas mixture being introduced into said vessel.

18. A process as set forth in claim 17 wherein said heater comprises a burner which produces hot flue gases by combusting a suitable hydrocarbon fuel, said heated gas introduced into said vessel to supply heat to said unfired heat exchange/reaction zone comprising said hot flue gases.

19. A process as set forth in claim 17 wherein said heated gas produced by said heater is introduced into said vessel through said bypass port during said transitional step to supply heat to said unfired heat exchange/reaction zone.

20. A process as set forth in claim 19 wherein said heated gas produced by said heater comprises feed gas mixture.

21. A process as set forth in claim 17 wherein feed gas mixture introduced into said vessel through said bypass system passes directly from said bypass system into said gas-permeable bed.

22. A process as set forth in claim 17 wherein the reactor further comprises a blower downstream of said vessel relative to the flow of reacted gas exiting said vessel, the process comprising diverting a fraction of the flow of reacted gas discharged from said vessel back to said vessel during the transitional step such that the diverted reacted gas is used to purge unreacted feed gas from said unfired heat exchange/reaction zone.

23. A process as set forth in claim 17 further comprising introducing a supplemental hydrocarbon fuel into said vessel along with said feed gas mixture.

24. A process as set forth in claim 23 wherein said supplemental hydrocarbon fuel is combined with said feed gas mixture being introduced into said vessel through said bypass port during said transitional step.

25. A process as set forth in claim 17 wherein said bypass system comprises two bypass ports on said vessel intermediate said ends of said vessel and in selective fluid communication with said bypass line, said bypass ports being off-set from the center of said vessel such that one of said bypass ports is closer to one end of said vessel and the other of said bypass ports is closer to the other end of said vessel, the transitional step comprising introducing the feed gas mixture into said vessel through the bypass port nearest the end of said vessel which served as the reacted gas inlet immediately prior to the transitional step and purging unreacted feed gas mixture from said unfired heat exchange/reaction zone between the end of said vessel which served as the feed gas mixture inlet immediately prior to the transitional step and said bypass port through which the feed gas mixture is introduced during the transitional step.

26. A process as set forth in claim 25 wherein feed gas mixture introduced into said vessel through said bypass system passes directly from said bypass system into said gas-permeable bed.

27. A regenerative heat transfer reactor for oxidizing components of a feed gas mixture, the reactor comprising:

a vessel having two ends, the interior of said vessel defining a heat exchange/reaction zone containing a gas-permeable bed comprising heat exchange material, said heat exchange material extending substantially throughout said heat exchange/reaction zone;

a gas handling system for selectively introducing the feed gas mixture into one of said ends of said vessel and discharging reacted gas comprising oxidized components of the feed gas mixture through the other of said ends of said vessel such that each of said ends of said vessel alternately serves as an inlet for the feed gas mixture and as an outlet for the reacted gas and direction of gas flow through said vessel is reversed;

a bypass system for selectively introducing the feed gas mixture into said vessel at a point intermediate said ends of said vessel during a transitional step in reversing the direction of gas flow through said vessel, said bypass system comprising a bypass port on said vessel intermediate said ends of said vessel and in selective fluid communication with a bypass line connected to a source of the feed gas mixture, said bypass system and said gas-permeable bed being constructed and arranged such that feed gas mixture introduced into said vessel through said bypass system passes directly from said bypass system into said gas-permeable bed; and a purging system for purging unreacted feed gas mixture from said heat exchange/reaction zone during the transitional step, said purged gas being reacted prior to being discharged from the reactor.

28. A reactor as set forth in claim 27 wherein said bypass system further comprises a gas distributor in fluid communication with said bypass port for distributing the feed gas mixture introduced into said vessel through said bypass system within said heat exchange/reaction zone, said gas distributor being disposed within said gas-permeable bed in contact with said heat exchange material.

29. A reactor as set forth in claim 28 wherein said gas distributor comprises an array of perforated pipes.

30. A reactor as set forth in claim 28 wherein said gas-permeable bed comprises structured packing material adjacent said gas distributor.

31. A reactor as set forth in claim 27 wherein said heat exchange material comprises catalyst.

32. A reactor as set forth in claim 31 wherein said gas-permeable bed comprises a layer of catalyst interposed between layers of inert heat exchange material.

33. A process for oxidizing components of a feed gas mixture in a regenerative heat transfer reactor, the reactor comprising a vessel having two ends, the process comprising:

supplying heat to a heat exchange/reaction zone, said heat exchange reaction zone being defined by the interior of said vessel and containing a gas-permeable bed comprising heat exchange material, said heat exchange material extending substantially throughout said heat exchange/reaction zone;

introducing the feed gas mixture into said vessel through one of said ends of said vessel, the feed gas mixture introduced into said vessel flowing into said gas-permeable bed and contacting said heat exchange material such that heat stored in said heat exchange material is transferred to the feed gas mixture and thereby heats the feed gas mixture;

oxidizing components of the feed gas mixture in said gas-permeable bed to produce reacted gas comprising the oxidized components of the feed gas mixture;

contacting said heat exchange material with the reacted gas such that heat is transferred from the reacted gas to said heat exchange material and thereby cools the reacted gas;

discharging the cooled reacted gas from said vessel through the other of said ends of said vessel;

reversing the direction of gas flow through said vessel in a continuing series of cycles by introducing the feed gas mixture into said other end of said vessel so that heat that has been transferred from the reacted gas to said heat exchange material is transferred to the feed gas mixture introduced into said vessel; and as a transitional step in each complete reversal of the direction of gas flow through said vessel, introducing the feed gas mixture into said vessel through a bypass port on said vessel intermediate said ends of said vessel, said bypass port being part of a bypass system comprising said bypass port in selective fluid communication with a bypass line connected to a source of the feed gas mixture, said bypass system and said gas-permeable bed being constructed and arranged such that feed gas mixture introduced into said vessel through said bypass port passes directly from said bypass system into said gas-permeable bed and bypasses a portion of said gas-permeable bed, passing feed gas mixture through the remainder of said gas-permeable bed downstream of said bypass port with respect to the direction of gas flow through said vessel, feed gas mixture being heated within the remainder of the gas-permeable bed to oxidize components of the feed gas mixture and produce reacted gas comprising the oxidized components of the feed gas mixture, discharging reacted gas from the end of said vessel which served as the reacted gas outlet immediately prior to the transitional step, purging unreacted feed gas mixture from said heat exchange/reaction zone between the end of said vessel which served as the feed gas mixture inlet immediately prior to the transitional step and said bypass port, and combining the purged unreacted feed gas with feed gas mixture being introduced into said vessel.

34. A process as set forth in claim 33 further comprising introducing a supplemental hydrocarbon fuel into said vessel along with said feed gas mixture.

* * * * *